United States Patent [19]

Meister et al.

[11] 4,271,339

[45] Jun. 2, 1981

[54] HIGH VOLTAGE CIRCUIT SWITCH ARRANGEMENT

[75] Inventors: Otto Meister, Arlington Heights; Thomas J. Tobin, Morton Grove, both of Ill.

[73] Assignee: S&C Electric Company, Chicago, Ill.

[21] Appl. No.: 854,125

[22] Filed: Nov. 23, 1977

Related U.S. Application Data

[63] Continuation of Ser. No. 693,290, Jun. 7, 1976, abandoned.

[51] Int. Cl.[3] ..... H01H 33/08

[52] U.S. Cl. ..... 200/144 C; 200/144 R; 200/146 R; 200/149 R

[58] Field of Search ..... 200/146 R, 144 R, 144 C, 200/149 R

[56] References Cited

U.S. PATENT DOCUMENTS

| | | | |
|---|---|---|---|
| 3,144,536 | 8/1964 | Bridges et al. | 200/146 R |
| 3,308,259 | 3/1967 | Hulteen et al. | 200/146 R |
| 3,542,986 | 11/1970 | Kotski | 200/149 R |
| 4,008,943 | 2/1977 | Flatt et al. | 200/144 C |

*Primary Examiner*—Robert S. Macon
*Attorney, Agent, or Firm*—John D. Kaufmann

[57] ABSTRACT

A rapid opening and closing interrupter includes a stationary contact mounted in a cylindrical housing and a moving contact mounted on an operating rod by an opening spring. A trailer formed of a material that produces an arc quenching gas when exposed to an arc is mounted on the moving contact, and an engaging nipple is formed on the end of the trailer. A snap spring engages the nipple in such a manner that when the operating rod is moved in a direction to open the contacts, the contacts remain in engagement until the force exerted by the opening spring overcomes the force exerted by the snap spring on the engaging nipple causing the contacts to snap open rapidly. Vent holes are provided in the moving contact so that arc gase, formed during closing by the pre-strike arc, are released from a gas confining area between the moving contact and the trailer through the vent holes so that a net force results against the trailer in the direction of closing thereby causing the moving contact to accelerate towards closing with the stationary contact.

24 Claims, 7 Drawing Figures

HIGH VOLTAGE CIRCUIT SWITCH ARRANGEMENT

This is a continuation of application Ser. No. 693,290, filed June 7, 1976 now abandoned.

BACKGROUND OF THE INVENTION

1. Field of the Invention

The present invention relates to high voltage circuit interrupters and more particularly to compact easily operated circuit interrupters particularly suitable for metal enclosed high voltage load switching equipment.

2. Description of the Prior Art

Various types of high voltage circuit interrupter switches have been developed to effect efficient interruption of current flow in high voltage circuits. One type of circuit interrupter switch is commonly known as a trailer-liner interrupter which utilizes a cylindrical trailer and tubular liner formed of a material that produces an arc quenching gas upon exposure to an electrical arc when the switch contacts are opened.

The need for compact, metal-enclosed, high voltage switching equipment and circuit interrupters is well known, particularly for underground distribution systems. Various devices for three-phase, dead-front, operator independent switching are commercially available. However, these interrupters typically involve the utilization of complex operating mechanisms which operate on some form of stored energy principle to rapidly open and close the contacts. To effect single phase interruption of a multi-phase circuit, either a multiplicity of operating mechanisms (one for each phase), or an interconnected, sequentially operating mechanism must be provided.

Thus, it would be a highly desirable advance in the art to provide a high voltage circuit interrupter utilizing a simple, inexpensive mechanism for single phase switching.

Similar devices of which the present invention is an improvement are shown in U.S. Pat. No. 4,008,943, issued Feb. 22, 1977, and U.S. Pat. No. 3,542,986, issued Nov. 24, 1970.

SUMMARY OF THE INVENTION

A high voltage circuit interrupting switch arrangement for interrupting current flow between separate points of an electrical circuit in accordance with the present invention comprises a hollow cylindrical housing and a stationary electrical contact positioned within the housing that is connected to one point of the electrical circuit. Also provided is a movable contact means including an operating means which is connected to the other point of the electrical circuit. The operating means causes linear movement of the movable contact means within the hollow cylindrical housing. The movable contact means includes a contact head dimensioned to electrically engage the stationary contact and having gas vent holes formed through it. Connecting one side of the contact head to the operating means is a spring bias means. A trailer means is mounted on the other side of the contact head. The trailer means is formed so that a gas confining area is provided between the trailer means and the contact head. Further, the trailer means is fabricated from a material that produces an arc quenching gas when exposed to an electrical arc. Formed at the other end of the trailer means is an engaging means. A snap spring means is mounted within the stationary cylindrical housing for engaging the engaging means and retaining the contact head in engagement with the stationary contact as the operating means moves in a direction to open the contact. When the spring bias means has been biased to provide sufficient force to overcome the snap spring means engagement of the engaging means, the contact head will rapidly disengage the stationary contact and move towards the operating means.

Upon closing, as the contact head approaches the stationary contact and a pre-strike arc is formed, gas is formed and enters the gas confining area, but since gas vent holes are formed in the contact head the surface area of the contact head is less than the surface area of the trailer means. Consequently, a net force is exerted by the gas against the trailer means which causes the contact head to be rapidly moved into engagement with the stationary contact. Gas pressure behind the contact head also exerts a net force in the direction of closing. Consequently, the present invention provides a simple inexpensive means for both rapidly opening and rapidly closing the contacts of the interrupting switch arrangement without the need for an expensive or complicated operating mechanism.

Additionally, to increase available arc quenching gas, a liner may also be positioned adjacent the stationary contact and the contact head so that the arc is drawn across the liner as the contacts open and close. The liner is formed of a material that produces an arc quenching gas when exposed to an electrical arc. Also, gas exhaust means may be positioned adjacent the stationary contact and contact head for exhausting the arc gases to the atmosphere. Typically, the exhaust means could comprise alumina particles within a muffler for condensing the hot arc gases.

The present invention may be utilized in a variety of high voltage switching arrangements. Typically, the operating means could be connected to a fuse mounted on a linear moving fuse drawer so that the opening of the fuse drawer would interrupt current flow through the fuse so that the fuse could be removed, inspected and replaced if necessary. A similar arrangement would comprise mounting the operating means on a fuse muffler mounted on a hinged door mechanism so that opening of the hinged door mechanism causes movement of the operating means thereby interrupting current flow.

Thus, it is a primary object of the present invention to provide a high voltage circuit interrupting switch arrangement consisting of a simple, in line spring mechanism which in combination with a contact-trailer interrupter provides a means for quickly separating metallic contacts.

It is a further object of the present invention to provide a high voltage circuit interrupting switch arrangement having a gas actuated means which uses the gas generated during pre-strike arcing upon closing of the contacts to accelerate the movement of the electrical contacts toward one another thereby minimizing arcing time and reducing the damage to the metallic contacts.

A further object of the present invention is to provide a high voltage circuit interrupting switch arrangement which can be attached to a fuse in a conventional fuse drawer arrangement such that upon removal of the fuse for replacement or isolation, the interrupting switch arrangement would be actuated by the fuse drawer removal so that the circuit is safely interrupted.

These and other objects, advantages and features of the subject invention will hereinafter appear, and for the purposes of illustration but not of limitation, exemplary embodiments of the subject invention are shown in the accompanying drawings.

DESCRIPTION OF THE PREFERRED EMBODIMENTS

Figure 1:
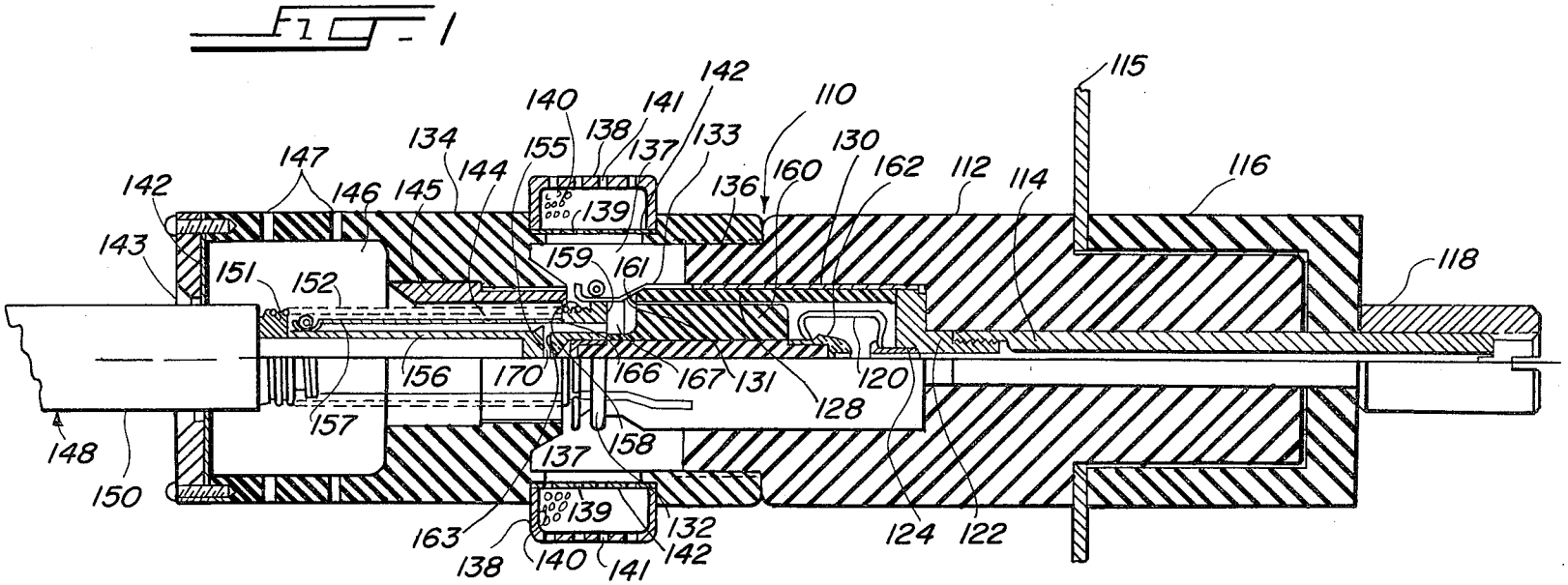
FIG. 1 is a side cross-sectional view of a preferred embodiment of the present invention.
Figure 2:
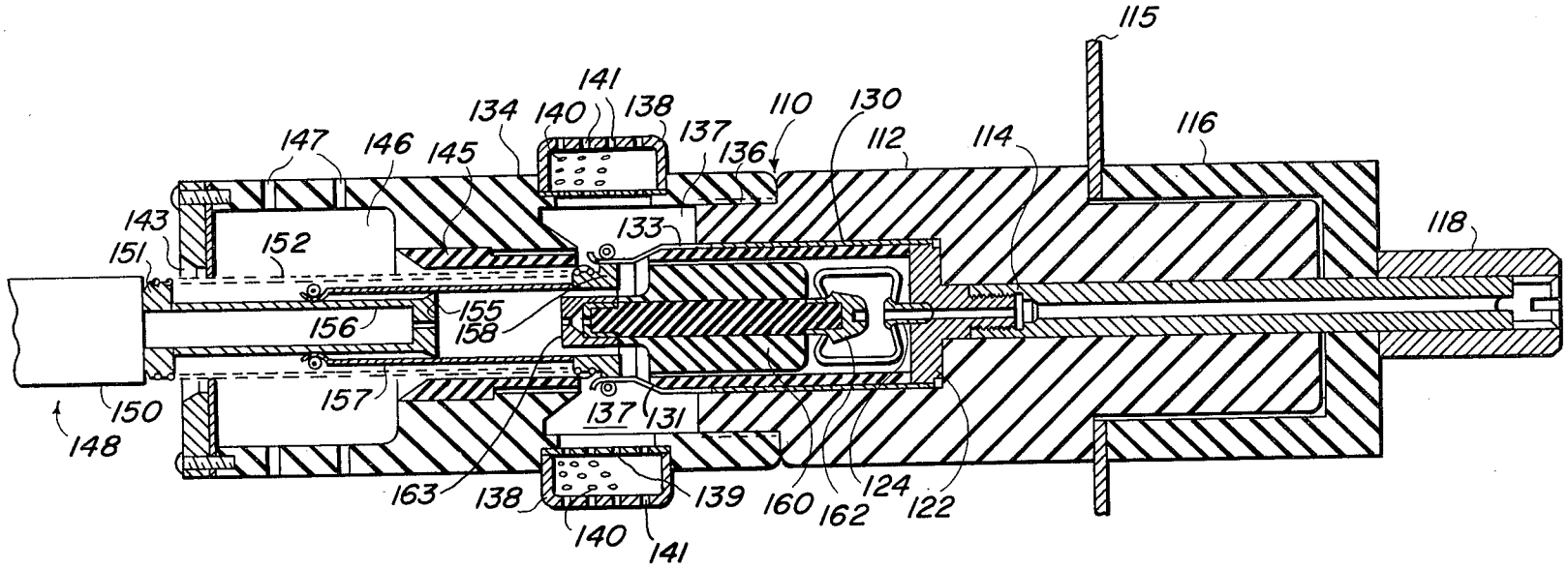
FIG. 2 is a cross-sectional view of the embodiment illustrated in FIG. 1 showing initiation of the opening sequence.
Figure 3:
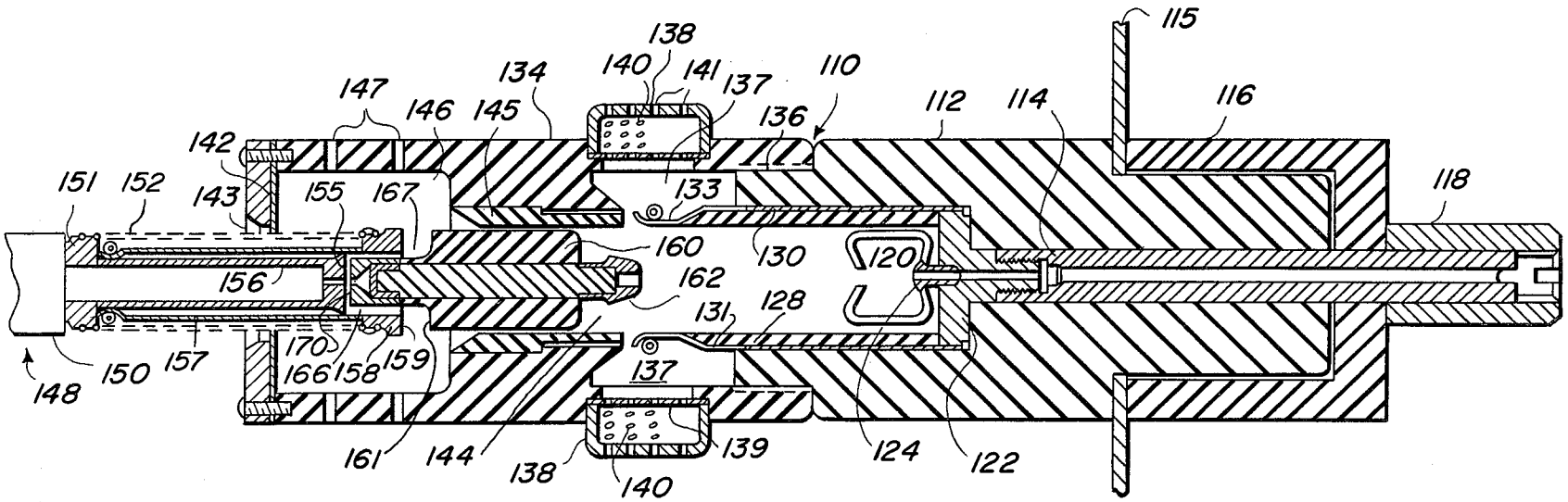
FIG. 3 is a cross-sectional view of the embodiment illustrated in FIG. 1 showing the contacts in the opened position.

With reference to FIGS. 1, 2, and 3, high voltage circuit interrupting switch arrangement 110 comprises a hollow cylindrical rear housing 112 through one end of which a terminal connector 114 is mounted. The cylindrical rear housing 112 is mounted on a wall 115 of an enclosure (not shown) and held in position by a stationary cap end 116 and high voltage circuit connection 118. A detent snap spring 120 is mounted on connector adapter 122 and held in place by center screw 124. Connector adapter 122 is screwed into terminal connector 114 and anchored to the cylindrical housing rear chamber 112. A gas retaining liner 128 is positioned within the hollow interior of stationary contact 130. Stationary contact 130 is of cylindrical cross section and has a necked portion 131 surrounded by garter spring 132. Necked portion 131 of stationary contact 130 includes a plurality of flexible individual contact fingers 133.

Hollow cylindrical front housing 134 is connected to cylindrical rear housing 112 by means of threads 136, and a gas chamber 137 is formed between rear housing 112 and front housing 134. Above and below gas chamber 137 are exhaust gas mufflers 138 which communicate with gas chamber 137 through openings 139 in perforated cover 142. Mufflers 138 are filled with activated alumina particles 140 which are retained in place by perforated cover 142. The alumina particles 140 act to cool and condense hot arc gases before they are vented to the atmosphere through openings 141 in mufflers 138.

Cylindrical front housing 134 forms a hollow shaft 144 which is lined by an arc quenching gas producing liner 145. Hollow shaft 144 opens into rear exhaust gas chamber 146 having vent holes 147, seal 142 and seal retainer 143.

Movable contact trailer assembly 148 comprises operating rod 150, composed of a fuse or other metallic connection to a high voltage circuit, connected by adapter 151, resilient opening spring 152, inner conducting tube 156, and sliding contact tube 157 to moving contact head 158, trailer 160, and engaging nipple 162. Inner conducting tube 156 is attached to operating rod 150 by means of adapter 151 and slidably engages sliding contact tube 157 which is mounted on moving contact head 158. Inner conducting tube 156 and sliding contact tube 157 carry the current between operating rod 150 with adapter 151 and moving contact 158. Resilient opening spring 152 is connected at one end to contact head 158 and at the other end to operating rod 150 by means of adapter 151. Moving contact head 158 and trailer 160 form moving contact gas confining area 167 between surface 159 of contact head 158 and surface 161 of trailer 160. Moving contact 158 and inner conducting tube 156 form spring expansion gas area 170 between the end wall 155 of inner conducting tube 156 and rear wall 163 of contact head 158. Contact head 158 has vent holes 166 that communicate with spring expansion gas area 170 and reduce the surface area of surface 159.

Operation of the embodiment illustrated in FIG. 1 is shown in FIGS. 2 and 3. Movement of operating rod 150 to the left (as viewed in FIGS. 2 and 3) causes extension of the opening spring 152 while the moving contact 158 and trailer 160 are held in place by detent snap spring 120 engaging nipple 162 (see FIG. 2). When opening spring 152 has been extended to the point where the force exerted by opening spring 152 overcomes the force exerted by snap spring 120 on engaging nipple 162, engaging nipple 162 disengages snap spring 120, and thus opening spring 152 quickly pulls the moving contact head 158 and trailer 160 away from stationary contact 130 thereby rapidly separating contact head 158 and stationary contact 130, as shown in FIG. 3. If an alternating current is being conducted through the interrupter, an electric arc will be drawn in the annular gap between trailer 160 and liner 145 as contact head 158 and stationary contact 130 separate. The energy released by the arc causes decomposition of the trailer and liner materials into an arc quenching gas. The rapid flow of gas out of the annular space cools the arc such that at a subsequent current zero, the circuit is efficiently interrupted. The hot gas released flows into gas chamber 137 and is vented through openings 139 into muffler 138, wherein the gases are cooled by activated alumina particles 140 and vented through vent holes 141. Gas is also collected in rear exhaust gas chamber 146 and vented to the atmosphere through vent holes 147. Alternatively, a muffler may be used if the gas flow through vent holes is objectionable.

Referring to FIG. 3, contact closing is accomplished by inserting contact-trailer assembly 148 into hollow shaft 144 formed by front housing 134. As contact-trailer assembly 148 is moved to the right (as viewed in FIG. 3) and assuming that open-circuit voltage is present between contact head 158 and stationary contact 130, a pre-strike arc will result causing the release of gas as trailer 160 and liner 145 decompose, and gas pressure will increase rapidly in gas confining area 167. Since surface 159 of moving contact head 158 has a smaller surface area than surface 161 of trailer 160 because of gas vent holes 166, the gas pressure will create a net force to the right on surface 161 that will drive moving contact 158 and trailer 160 towards stationary contact 130. The arc quenching gas which escapes through gas vent holes 166 in moving contact head 158 upon formation of a pre-strike arc is trapped in spring expansion gas volume 170, which is formed by inner conducting tube 156 and moving contact head 158. The resulting gas pressure in this volume causes the expansion of spring expansion gas volume 170 and opening spring 152 resulting in additional acceleration of moving contact head 158 in the direction of stationary contact 130. Consequently, moving contact head 158 and trailer 160 may be moved at a faster rate of speed than the operating rod 150 as permitted by the resulting elongation of opening spring 152. Accordingly, moving contact 158 will quickly accelerate toward stationary contact 130 to complete the metallic circuit thereby minimizing the arcing time and the damage due to the arcing. Gas produced during closing is collected in gas chamber 137 and vented to the atmosphere through the activated alumina particles 140 in muffler 138. The close fit of trailer 160 within gas retaining liner 128 retards the flow of gas thereby reducing the build-up of gas in the volume formed by the trailer 160, liner 128 and connector adapter 122. Gas build-up in this volume would tend to retard the closing of contact-trailer assembly 148.

Figure 4:
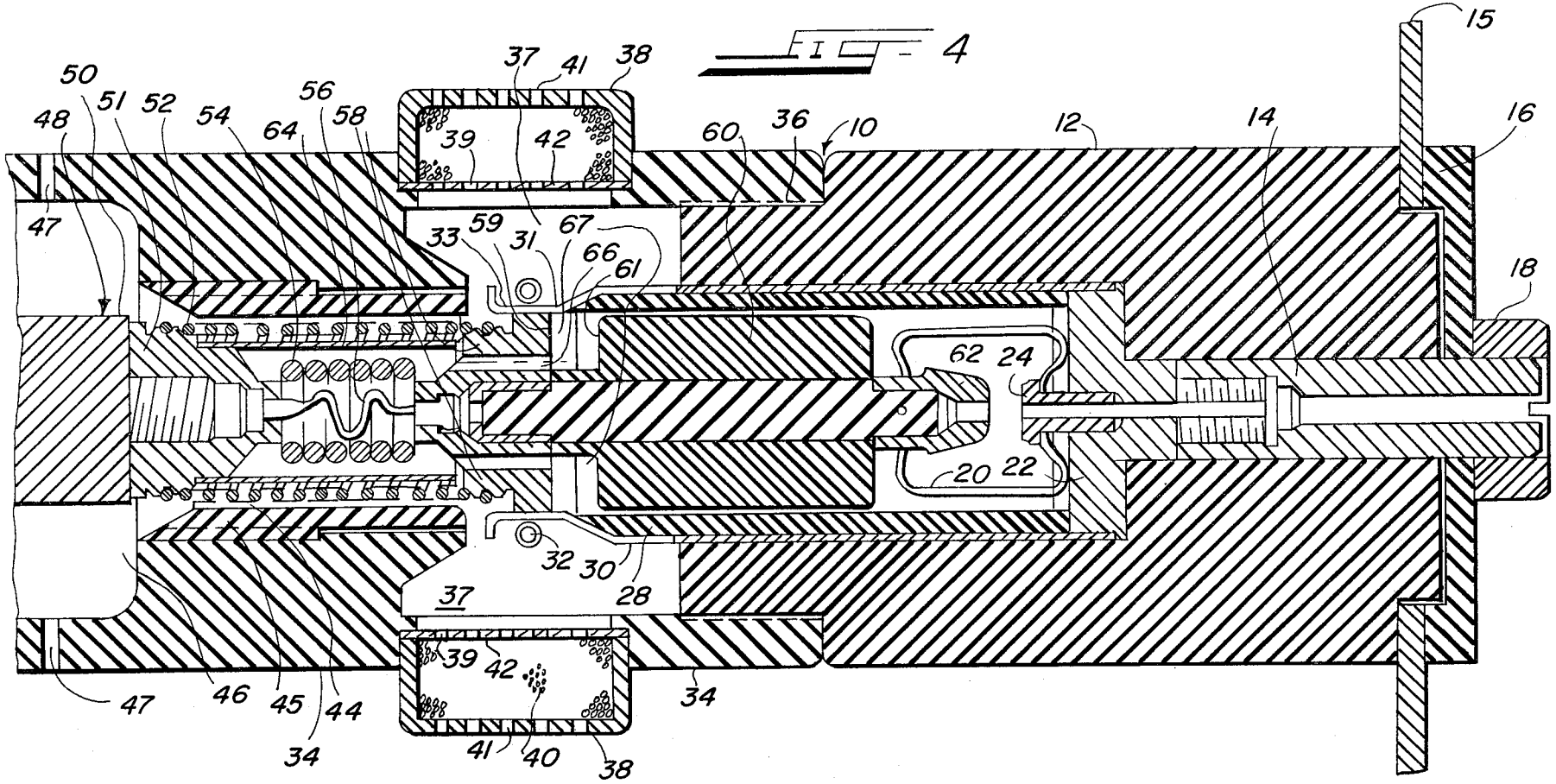
FIG. 4 is a cross-sectional view of an alternative embodiment of the present invention.

With reference to FIG. 4, illustrated is an alternative embodiment of a high-voltage circuit interrupting switch arrangement 10 comprising a cylindrical rear housing 12 through one end of which a terminal connector 14 is mounted. Cylindrical rear housing 12 is mounted on wall 15 of a grounded enclosure (not shown) and is held in position by stationary cap end 16 and high voltage circuit connection 18. Snap spring 20 is mounted on connector adapter 22 and held in place by center screw 24. Gas retaining liner 28 is positioned within the hollow interior of stationary contact 30. Stationary contact 30 is of cylindrical cross section and has a necked portion 31 surrounded by garter spring 32. Necked portion 31 of stationary contact 30 includes a plurality of flexible individual contact fingers 33.

Cylindrical front housing 34 is connected to cylindrical rear housing 12 by means of threads 36, and a gas chamber 37 is formed between rear housing 12 and front housing 34. Above and below gas chamber 37 are exhaust gas mufflers 38. Exhaust gas mufflers 38 communicate with gas chamber 37 through openings 39 in perforated cover 42, and mufflers 38 are filled with activated alumina particles 40 which are retained in place by perforated cover 42. The cooled gas is vented to the atmosphere through vent holes 41. Cylindrical front housing 34 forms a hollow shaft 44 which is lined by an arc quenching gas producing liner 45. Hollow shaft 44 opens into rear exhaust gas chamber 46 having vent holes 47.

Movable contact-trailer assembly 48 comprises operating rod 50, composed of a fuse or other metallic connection to a high voltage circuit, connected by adapter 51 opening spring 52, copper braid 54 and stainless steel braid 56 to moving contact head 58, trailer 60 and engaging nipple 62. A hollow gas collecting tube 64 is attached to adapter 51 and extends toward contact head 58. Moving contact head 58 and trailer 60 form moving contact gas confining area 67 between surface 59 of contact head 58 and surface 61 of trailer 60. Moving contact head 58 contains gas vent holes 66 that communicate between the gas confining area 67 and the opposite side of contact head 58 thus reducing the surface area of surface 59.

The operation of the alternative embodiment shown in FIG. 4 is substantially the same as that described in the FIG. 1 embodiment with the exception that upon closing, gas collecting tube 64 collects the gas escaping through gas vent holes 66 causing a pressure increase behind moving contact 58 to aid in accelerating the closing of the contacts. Upon opening, stainless steel wire 56 is fully extended before snap spring 20 releases thereby exerting additional pull on moving contact 58.

It should be noted that for both embodiments described, the gas pressure building up behind the moving contact head (58 and 158) not only accelerates the moving contact toward the stationary contact but also tries to move the operating rod (50 and 150) backwards. There is very little motion of the operating rod because the small mass of the moving contact head permits it to quickly complete the circuit, thereby reducing the gas pressure before the operating rod has moved.

Figure 5:
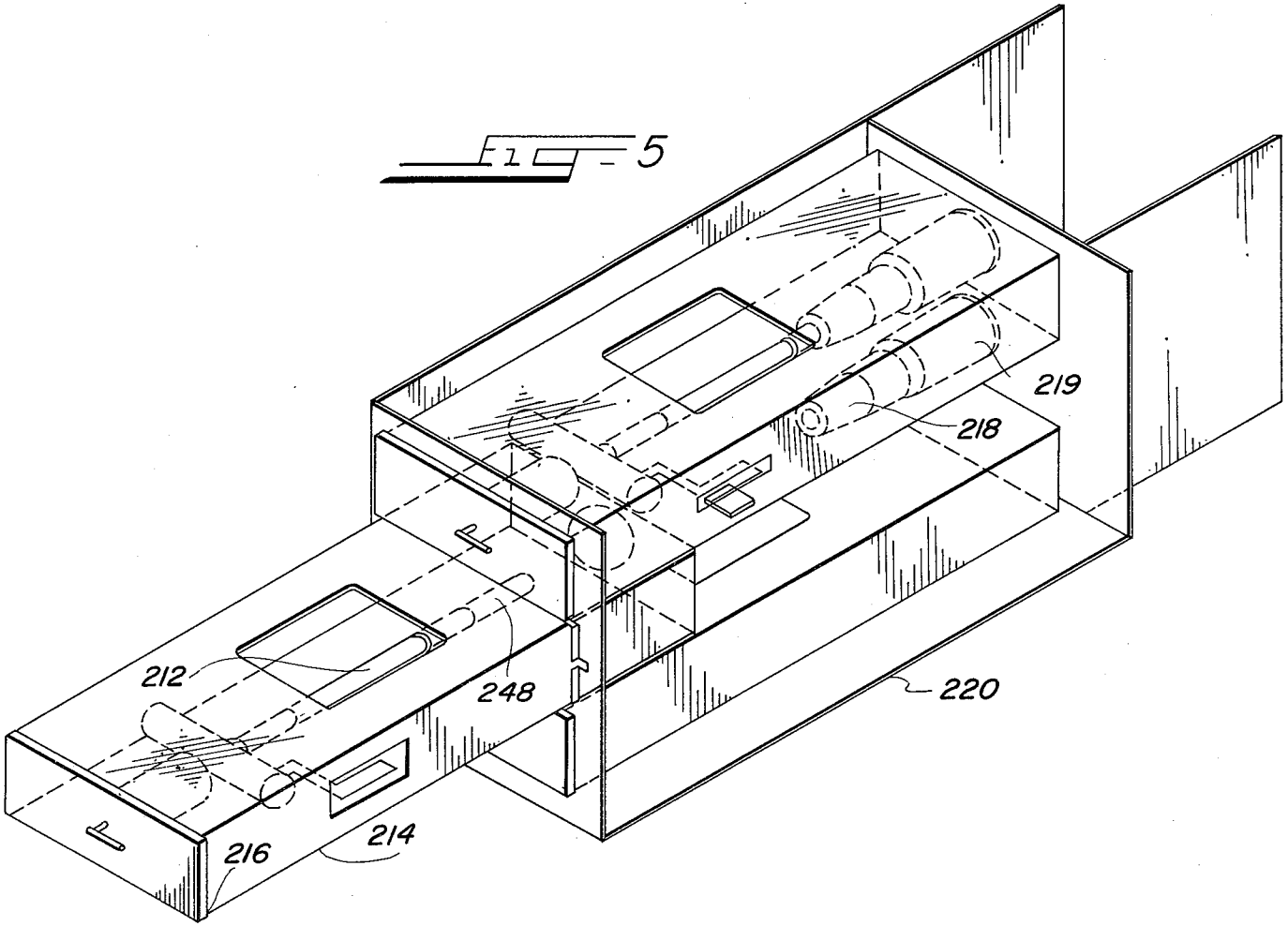
FIG. 5 is an upper right perspective view of a fuse drawer mounting arrangement for the present invention.

FIG. 5 shows one type of mounting arrangement for the present invention. A high voltage current interrupting switch arrangement contact-trailer assembly 248 (corresponding to assembly 148 in FIG. 1 and assembly 48 in FIG. 4) is attached to a fuse 212 and mounted inside an insulated drawer 214 having a grounded drawer front 216 (grounding means not shown). Front and rear cylindrical housings 218 and 219 (corresponding to housings 112 and 134 in FIG. 1 and housings 12 and 34 in FIG. 4) are mounted in a metal enclosed cabinet 220. Opening and closing the drawer 214 opens and closes the circuit as described above.

Figure 6:
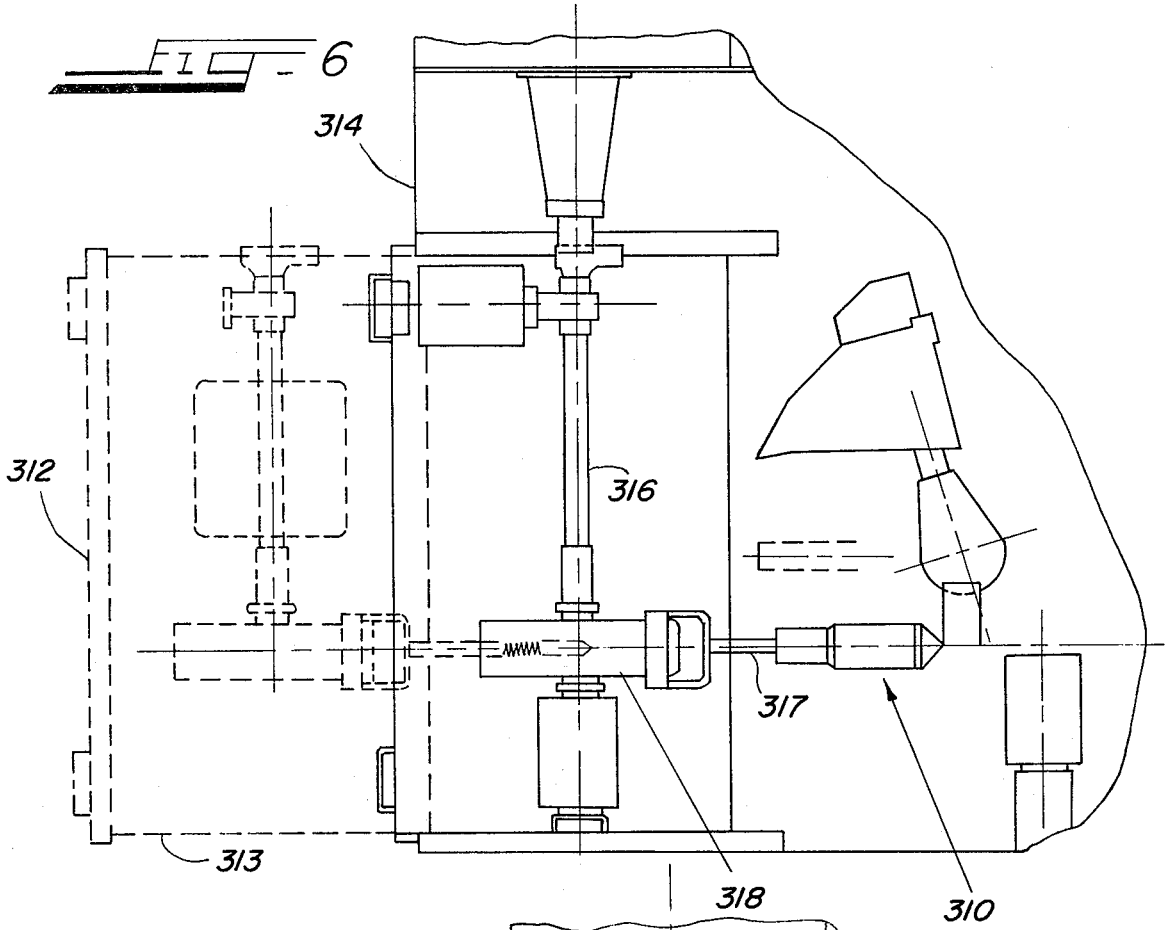
FIG. 6 is a top partially fragmentary view of a laterally moving fuse drawer mounting arrangement for the present invention.

FIG. 6 shows an alternative drawer-like carriage design for mounting the high voltage circuit interrupting switch arrangement 310 (corresponding to arrangement 110 in FIG. 1 and arrangement 10 in FIG. 4). A metal front cover 312 is mounted on drawer-like carriage 313 and can be grounded to the metal enclosed cabinet 314 in order to permit safe barehand opening and closing. The carriage can be designed to permit operator contact with fuse 316 only after proper clearance from the high voltage circuit has been attained. In FIG. 6, an operating rod 317 is mounted on a fuse exhaust control device 318 so that the opening of carriage 313 causes interrupter switch operation as previously described.

Figure 7:
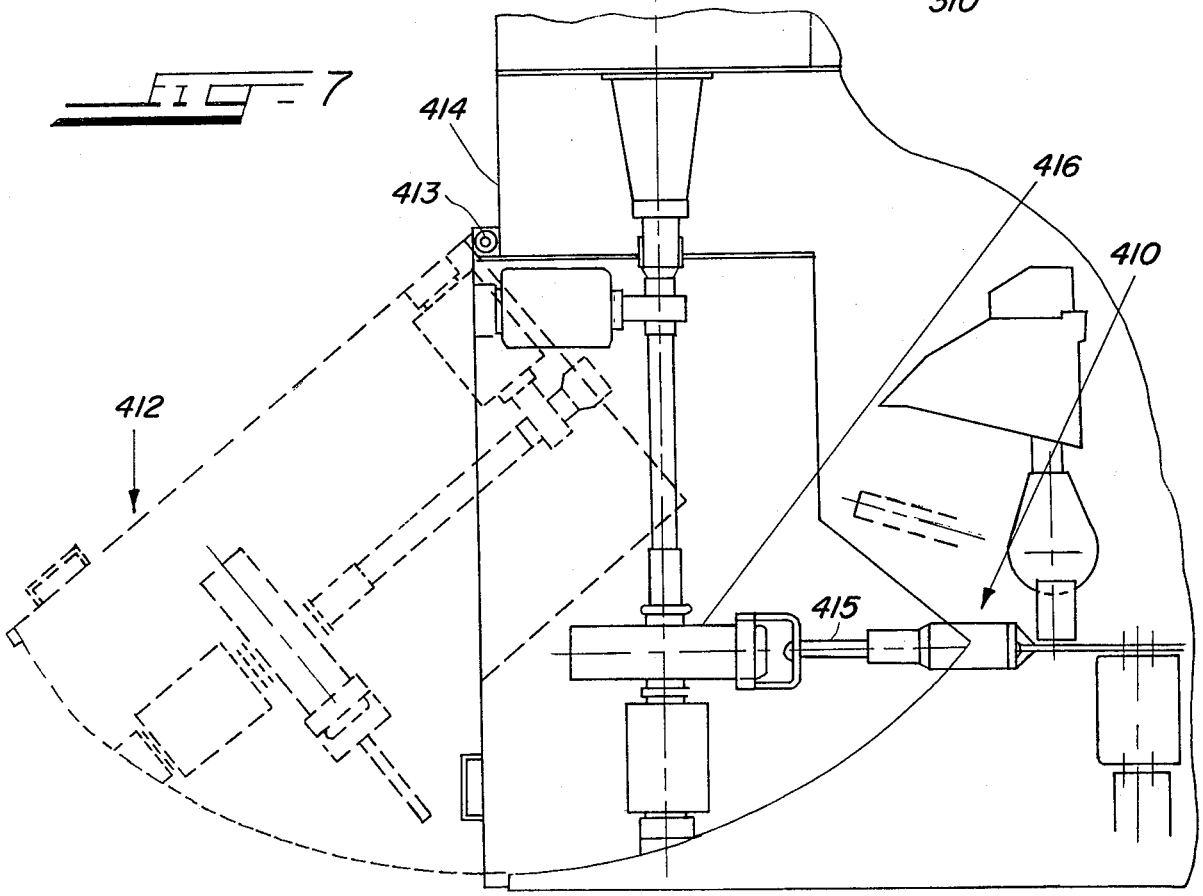
FIG. 7 is a top partially fragmentary view of a hinged fuse drawer mounting arrangement for the present invention.

FIG. 7 shows another drawer-like carriage design. Carriage 412 is hinge mounted by hinge 413. A high voltage circuit interrupting switch arrangement 410 in accordance with the present invention is mounted in cabinet 414 so that opening of carriage 412 causes movement of operating rod 415 mounted on exhaust control device 416 to produce interrupter switch action as described above.

In all of the above mountings of the high voltage circuit interrupting switch arrangement, the carriage provides suitable guiding such that opening and closing can be performed by an operator without tools or specialized training.

It should be understood that various changes, modifications and variations in structure and function of the present invention may be affected without departing from the spirit and scope of the present invention as defined in the following claims.

I claim:

1. A high voltage circuit interrupting switch arrangement for initiating and interrupting current flow between a first point and a second point of an electrical circuit comprising:

a hollow housing;

a stationary electrical contact positioned within the housing and connectable to the first point of the electrical circuit; a movable contact means including:

operating means for reciprocating said movable contact means, said operating means being connectable to the second point of the electrical circuit, a contact head dimensioned to electrically engage with said stationary contact, said contact head having a gas vent opening formed therein, resilient means connecting one side of said contact head to said operating means, trailer means mounted at one end on the other side of said contact head and formed of a material that produces an arc quenching gas when exposed to an electrical arc, and engaging means formed on the other end of said trailer means; and detent means mounted within said housing for engaging said engaging means and retaining said contact head in engagement with said stationary contact as said operating means moves in a direction to open said contacts until said resilient means is loaded to provide sufficient force to overcome engagement of said detent means with said engaging means so that said contact head rapidly disengages said stationary contact;

said gas vent opening providing reduced area pressure relief so that when said operating means is moved in a direction to close said contact head and said stationary contact and a pre-strike arc is formed therebetween, said arc quenching gas, confined between said contact head and said trailer means, applies a net force to said trailer means, thereby forcing said contact head into rapid engagement with said stationary contact.

2. A high voltage circuit interrupting switch arrangement as claimed in claim 1 further comprising liner means positioned within said housing adjacent said stationary contact and along the path of reciprocating movement of said movable contact means, said liner means formed of a material for producing an arc quenching gas when exposed to an electrical arc.

3. A high voltage circuit interrupting switch arrangement as claimed in claim 1 further comprising gas exhaust means positioned adjacent said stationary contact for exhausting arc gases to the atmosphere.

4. A high voltage circuit interrupting switch arrangement as claimed in claim 3 wherein said exhaust means comprises an alumina particle muffler.

5. A high voltage circuit interrupting switch arrangement as claimed in claim 1 wherein said operating means comprises a fuse.

6. A high voltage circuit interrupting switch arrangement as claimed in claim 1 wherein said operating means comprises a fuse mounted on a linear moving fuse carriage so that opening of said fuse carriage causes movement of said operating means.

7. A high voltage circuit interrupting switch arrangement as claimed in claim 1 wherein said operating means is connected to a fuse mounted on a hinged cover mechanism so that opening of said hinged door mechanism causes movement of said operating means.

8. A high voltage circuit interrupting switch arrangement as claimed in claim 1 further comprising sealing means mounted on said housing around said operating means for preventing arc gas from escaping from said housing around said operating means.

9. A high voltage circuit interrupting switch arrangement as claimed in claim 1 further comprising a gas collecting means attached to said operating means providing for the collection of said arc gases released through said gas vent opening in said contact head, said arc gas collected in said gas collecting means causing a resulting force against said contact head whereby said contact head is forced into rapid engagement with said stationary contact.

10. A high voltage circuit interrupting switch arrangement for initiating and interrupting current flow between a first point and a second point of an electrical circuit comprising:

a hollow cylindrical housing;

a stationary electrical contact positioned within the housing and connectable to the first point of the electrical circuit, said stationary contact comprising a plurality of individual contact fingers;

a movable contact means including:

an operating rod for reciprocating said movable contact means in a linear direction, said operating rod being connectable to the second point of the electrical circuit, a contact head dimensioned to electrically engage with said stationary contact fingers, said contact head having a gas vent opening formed therein, an opening spring connecting one side of said contact head to said operating rod, a cylindrical trailer mounted on the other side of said contact head, said trailer formed of a material that produces an arc quenching gas when exposed to an electrical arc, and an engaging nipple formed on the other end of said trailer; and detent means mounted within said housing for engaging said engaging nipple and holding said contact head in engagement with said stationary contact as said operating rod moves in a direction to separate said stationary contact and said contact head until said opening spring is loaded to provide sufficient force to overcome said detent means engagement of said engaging nipple so that said contact head rapidly disengages said stationary contact;

said gas vent opening providing reduced area pressure relief so that when said operating rod is moved in a direction to close said contact head and said stationary contact and a pre-strike arc is formed, the generated arc gas located between said contact head and said trailer applies a net force to said trailer, whereby said contact head is forced into rapid engagement with said stationary contact.

11. A high voltage circuit interrupting switch arrangement as claimed in claim 10 further comprising an electrically conductive flexible copper braid connecting said operating rod to said contact head.

12. A high voltage circuit interrupting switch arrangement as claimed in claim 10 further comprising motion limiting means for connecting said operating rod to said contact head.

13. A high voltage circuit interrupting switch arrangement as claimed in claim 10 further comprising an annular liner positioned within said housing adjacent said stationary contact and along the path of reciprocating movement of said movable contact head, said liner formed of a material for producing an arc quenching gas when exposed to an electrical arc.

14. A high voltage circuit interrupting switch arrangement as claimed in claim 10 further comprising gas exhaust means positioned adjacent said stationary contact for exhausting arc gases to the atmosphere.

15. A high voltage circuit interrupting switch arrangement as claimed in claim 14 wherein said exhaust means comprises an alumina particle muffler.

16. A high voltage circuit interrupting switch arrangement as claimed in claim 10 wherein said operating rod is operatively connectable to a fuse mounted on a linear moving fuse carriage so that closing and opening of said fuse carriage initiates and interrupts current flow through said fuse.

17. A high voltage circuit interrupting switch arrangement as claimed in claim 10 wherein said operating rod is operatively connectable to a fuse mounted on a hinged cover mechanism so that closing and opening of said hinged cover mechanism initiates and interrupts current flow through said fuse.

18. A high voltage circuit interrupting switch arrangement as claimed in claim 10 further comprising sealing means mounted on said housing around said operating rod for preventing arc gas from escaping from said housing around said operating rod.

19. A high voltage circuit interrupting switch arrangement as claimed in claim 10 further comprising a hollow gas collecting tube attached at a first end to said operating rod and having its open second end position adjacent said gas vent opening in said contact head so that arc gases released through said gas vent opening in said contact head are collected in said hollow gas collecting tube, said arc gas collected in said gas collecting tube causing an additional resulting force against said contact head whereby said contact head is forced into rapid engagement with said stationary contact when said operating rod is moved in direction toward said stationary contact.

20. A high voltage circuit interrupting device as claimed in claim 10, wherein said movable contact means includes:

an inner conducting tube attached at a first end to said operating rod, and having a flat closed second end positioned adjacent said contact head; and a hollow sliding contact tube attached to said contact head, and positioned around and in slidable engagement with said inner conducting tube to form an expandable gas confining volume so that arc gases passing through said gas vent opening in said contact head, when said contact head is moved to cause a pre-strike arc upon closing, causes the expansion of said expandable gas confining volume thereby producing additional acceleration of said contact head into engagement with said stationary contact.

21. An improved high-voltage circuit interrupting device for initiating and interrupting current flow between a first point and a second point of an electric circuit; the device being of the type which includes:

(a) a first contact connectable to the first point;

(b) a second contact connectable to the second point, the contacts being selectively engageable with and disengageable from each other upon relative movement toward and away from each other;

(c) means for mounting the first contact, which mounting means includes a piston-like cylinder arrangement defining a variable volume, which volume upon expansion moves the first contact toward the second contact;

(d) means for evolving arc-quenching gas upon exposure to an arc; and (e) means for admitting gas produced by exposure of the gas-evolving means to a pre-strike arc into the variable volume as the contacts move toward engagement to accelerate the first contact toward the second contact;

wherein the improvement comprises:

the admitting means being a vent hole which is through the first contact, generally normal to an exterior surface portion thereof, and generally along the direction of relative movement of the first contact toward the second contact, the exterior surface portion being generally normal to the direction of such relative contact movement;

a member connected to the first contact; and a gas-confining area formed by the exterior portion of the first contact and by a facing surface of the connected member, the exterior surface portion of the first contact having a smaller area than the facing portion of the connected member so that the gas in the confining area applies a net force to the facing surface of the connected member in aid of the accelerative force of the expanding variable volume on the first contact.

22. The improved device of claim 21, wherein the member comprises a gas evolving trailer.

23. An improved high voltage circuit interrupting device for initiating and interrupting current flow between a first point and a second point of an electrical circuit; the device being of the type which includes a housing having a female electrical contact stationarily positioned therewithin and connectable to the first point; a male electrical contact selectively movable into and out of the housing to selectively engage and disengage the female contact, the male contact being connectable to the second point; means for moving the male contact, which moving means includes a conductive cylinder one end of which is closed by and carries the male contact, the cylinder receiving a conductive piston-like member for movement relative thereto; means for biasing the piston-like member toward the male contact; a trailer mounted on the male contact and extending away from the piston-like member and the cylinder, the trailer being receivable by the female contact; detent means in the housing for retaining the male contact in engagement with the female contact and the trailer therewithin as the piston-like member is moved away from the female contact against the biasing means until the biasing means is sufficiently loaded to overcome the retention of the detent means so that the male contact rapidly disengages the female contact; and accelerating means on the male contact responsive to increased gas pressure produced by a pre-strike arc during the simultaneous movement of the piston-like member and the cylinder which moves the male contact toward the female contact for accelerating the male contact toward the female contact; wherein the improvement comprises an improved accelerating means comprising:

a gas confining area defined by a surface of the male contact and a facing surface of the trailer; and a vent formed through and perpendicular to the male contact surface and communicating between the cylinder and the gas confining area, the male contact surface having a smaller area than the facing trailer surface, the gas produced by the pre-strike arc entering the cylinder through the vent to act between the piston-like member and the male contact and also applying a net force to the facing trailer surface from within the gas confining area.

24. The improved device of claim 23 wherein the detent means comprises:

an engaging nipple on the trailer on the end opposite the end connected to the male contact; and means in the housing for engaging the nipple when the contacts are engaged.

* * * * *